US006896565B2

(12) United States Patent
Kliewe

(10) Patent No.: US 6,896,565 B2
(45) Date of Patent: May 24, 2005

(54) PROTECTIVE CAGE FOR AN OUTBOARD MOTOR AND HOLDING DEVICE THEREOF

(75) Inventor: Günter Kliewe, Paul-Sorge-Strasse 104, 22459 Hamburg (DE)

(73) Assignees: Günter Kliewe, Hamburg (DE); Ulrich Pruesse, München (DE)

( * ) Notice: Subject to any disclaimer, the term of this patent is extended or adjusted under 35 U.S.C. 154(b) by 0 days.

(21) Appl. No.: 10/900,149

(22) Filed: Jul. 28, 2004

(65) Prior Publication Data

US 2005/0020151 A1 Jan. 27, 2005

Related U.S. Application Data

(63) Continuation of application No. PCT/EP03/00294, filed on Jan. 14, 2003.

(30) Foreign Application Priority Data

Jan. 29, 2002 (DE) ..... 102 03 381

(51) Int. Cl.[7] ..... B63H 5/16
(52) U.S. Cl. ..... 440/72; 416/247 R
(58) Field of Search ..... 440/67, 71, 72; 416/247 R

(56) References Cited

U.S. PATENT DOCUMENTS

| | | | | |
|---|---|---|---|---|
| 3,035,538 | A | | 5/1962 | Willard |
| 3,075,491 | A | | 1/1963 | Hogan |
| 4,013,033 | A | | 3/1977 | Porter et al. |
| 4,070,984 | A | | 1/1978 | Kappas |
| 4,078,516 | A | | 3/1978 | Balius |
| 4,680,017 | A | | 7/1987 | Eller |
| 4,826,461 | A | | 5/1989 | Newman |
| 4,832,634 | A | | 5/1989 | Kearns |
| 4,957,459 | A | | 9/1990 | Snyder |
| 4,998,496 | A | | 3/1991 | Shaw et al. |
| 5,009,620 | A | | 4/1991 | Feranda, Sr. |
| 5,066,254 | A | | 11/1991 | Bass et al. |
| D322,074 | S | | 12/1991 | Hansen |
| 5,073,088 | A | | 12/1991 | Peng |
| 5,176,550 | A | | 1/1993 | Hooper |
| 5,205,766 | A | | 4/1993 | Arsenault |
| 5,246,345 | A | | 9/1993 | Adams, Jr. |
| 5,470,262 | A | | 11/1995 | Bustillo, Sr. |
| 5,601,412 | A | | 2/1997 | Vice |
| 5,664,977 | A | | 9/1997 | Dinkowitz et al. |
| 5,759,075 | A | | 6/1998 | Steep et al. |
| D402,667 | S | | 12/1998 | Borrelli |
| 5,928,042 | A | * | 7/1999 | Quiggins ..... 440/72 |
| 6,123,098 | A | | 9/2000 | Gremillon, III |
| 6,190,220 | B1 | | 2/2001 | Borrelili |
| 2001/0036776 | A1 | | 11/2001 | Raps |
| 2002/0094730 | A1 | | 7/2002 | Schultz et al. |
| 2003/0017763 | A1 | | 1/2003 | Miller |
| 2004/0072480 | A1 | | 4/2004 | Pither |

FOREIGN PATENT DOCUMENTS

| | | |
|---|---|---|
| DE | 3737322 | 3/1989 |
| DE | 19903998 | 8/2000 |
| DE | 10203381 | 8/2003 |
| FR | 1289967 | 2/1962 |
| GB | 2152459 | 8/1985 |

* cited by examiner

*Primary Examiner*—Jesus D. Sotelo
(74) *Attorney, Agent, or Firm*—Greenblum & Bernstein, P.L..C.

(57) ABSTRACT

Arrangement for protecting an outboard motor. The arrangement includes a holding device which is made of steel and which is adapted to be detachably fixed to a shaft of the outboard motor. The holding device includes a ring element having U-shaped cross-sectional profile and at least one closure device. A protective cage includes at least one projecting part which projects radially outwards from an upper edge of the protective cage. The U-shaped cross-sectional profile defines an opening which is adapted to removably receive therein the at least one projecting part when the protective cage is fixed to the shaft of the outboard motor with the holding device. This Abstract is not intended to define the invention disclosed in the specification, nor intended to limit the scope of the invention in any way.

30 Claims, 2 Drawing Sheets

PROTECTIVE CAGE FOR AN OUTBOARD MOTOR AND HOLDING DEVICE THEREOF

CROSS-REFERENCE TO RELATED APPLICATIONS

The instant application is a continuation of International Application No. PCT/EP03/00294 filed on Jan. 14, 2003 and published as International Publication WO 03/064250 on Aug. 7, 2003, the disclosure of which is hereby expressly incorporated by reference hereto in its entirety. The instant application also claims priority under 35 U.S.C. §119 of German Application No. 102 03 381.1 filed on Jan. 29, 2002.

BACKGROUND OF THE INVENTION

1. Field of the Invention

The invention relates to a holding device for fixing a protective cage to the shaft of an outboard motor of a boat. The invention also relates to a protective cage for an outboard motor utilizing the holding device. The invention further relates to a method of protecting the propeller of an outboard motor as well as a method of attaching a protective cage to an outboard motor using the holding device.

2. Description of the Prior Art

Such a protective cage is usually attached to the shaft of the outboard motor. On the one hand this attachment must be stable, so that the protective cage, as far as possible, withstands a knock e.g., against a rock under water. On the other hand, the attaching much be carried out in a simple manner, so that when required, e.g., for cleaning and maintenance work on the propeller, the protective cage can be quickly removed from and reattached to the shaft of the outboard motor without special tools. Furthermore, it should be possible to easily fix the protective cage holding device to the shafts of different outboard motors available on the market or already in use.

Protective cages for outboard motors of boats are known (see, for example, DE 199 03 998 A1). They are used to protect people and animals from injury by the rotating propeller, as well as, to protect the propeller from knocking against hard objects, such as rocks that are difficult to see under water.

In U.S. Pat. No. 3,035,538 there is described a protective cage for an outboard motor of a boat. The protective cage and the related ring for fixing the cage on the boat motor are made in a single piece. Therefore, an economic manufacture requires that the protective cage be made of plastic, for example, by injection molding. However, such a plastic material has the disadvantage that in the long run it is neither corrosion resistant against salty sea water nor resistant to aging under strong sunlight exposure. This may lead to the fact that the corroded and/or aged plastic material shatters by an impact, which causes additionally a risk of injury. Besides this, the single-piece nature of the known protective cage makes its adapting to different forms of motors more difficult and increases the costs for a replacement of a cage deformed by an impact.

U.S. Pat. No. 3,075,491 also describes a protective cage for an outboard motor. The protective cage and the ring for fixing the cage at the motor are designed as a single piece, for example, by a welded joint.

DE 3727322 A1 describes an outboard aggregate for watercrafts, wherein the propeller for its protection is freely rotatable within a cage. The cage is provided with a collar for fixing it to the motor shaft. The single-piece nature if the cage and the collar leads to the above-mentioned disadvantageous.

SUMMARY OF THE INVENTION

The invention relates to a holding device for attaching a protective cage to the shaft of an outboard motor of a boat. The device can be easily and quickly attached to the motor shaft and just as easily removed therefrom. Furthermore, the invention makes it possible to fix the holding device to the motor shaft with sufficient stability that it is not displaced when knocked about. Finally, as far as possible, the invention makes it possible to attach the protective cage without structural changes being required to be made to the outboard motor.

The holding device according to the invention features, e.g., only a single closure with which, after it has been placed around the shaft of the outboard motor, it can be fixed thereto. In this case, the ring element is made of, e.g., a flexible material that makes it possible to remove the closure ends by pressing them so far apart that their distance is sufficient to place the ring element around the shaft of the outboard motor.

However, other embodiments of the holding device with only one closure of the ring element are possible, e.g., such that a circumferential section of the ring element adjacent to the closure is attached to the other part of the ring element by way of a hinge and can be swiveled outwards when the ring element is attached or removed.

According to one embodiment of the invention, a width of the opening of the U-shaped profile of the ring element is dimensioned such that the projecting part on the upper edge of the protective cage and a guiding plate attached to the shaft of the outboard motor can be arranged one above the other in it. Virtually every outboard motor is equipped with such a guiding plate. The invention uses it in a very advantageous manner, whereby the guiding plate is used as a support for the ring element and thus for the protective cage.

In another embodiment of the invention, the projecting part on the upper edge of the protective cage is composed of several projecting parts, e.g., of approximately 4 to approximately 10 projecting parts that are formed by small horizontal transverse plates that are respectively attached to the upper edge of profile bars which run from the top to the bottom of the protective cage.

According to a optimized embodiment of the invention, the U-shaped profile of the ring element is adapted to that of the profile bars running from the top to the bottom. In the use position of the holding device, the ring element in its circumferential direction in the lower leg of the U-shaped profile thereby features recesses that are spaced apart and used to accept the profile bars running from the top to the bottom of the protective cage. The number, arrangement and shape of the recesses in the ring element are matched to the number, arrangement and shape of the mentioned profile bars.

According to still another embodiment of the holding device according to the invention, instead of the individual projecting parts at the upper end of the referenced profile bars of the protective cage provided as explained above, a single projecting part is embodied which extends continuously across the entire circumference of the upper protective cage edge and thus represents a type of collar or flange part.

According to another embodiment of the invention, in the use position of the holding device, the length of the lower leg of the U-shaped profile is shortened by a lengthwise section across the entire circumference of the ring element. The lengthwise section corresponds to the horizontal thickness of the profile bars running from the top to the bottom of the protective cage in the area of the ring element. This embodiment has the advantage that precisely positioned individual recesses do not need to be cut out of the ring element. Instead, it is sufficient to shorten the lower leg of the U-shaped profile across the entire circumference of the ring element according to the desired recess depth.

For a practical use of the invention, the holding device, and also the cage, can preferably be made of steel, in particular, of a steel that is corrosion-resistant in fresh water and salt water.

The invention also provides for an arrangement for protecting an outboard motor, wherein the arrangement comprises a holding device which is made of steel and which is adapted to be detachably fixed to a shaft of the outboard motor. The holding device comprises a ring element having U-shaped cross-sectional profile and at least one closure device. A protective cage comprises at least one projecting part which projects radially outwards from an upper edge of the protective cage. The U-shaped cross-sectional profile defines an opening which is adapted to removably receive therein the at least one projecting part when the protective cage is fixed to the shaft of the outboard motor with the holding device.

The holding device may be removable from the protective cage and the opening extends in a generally horizontal direction. The opening may comprise a width which is sized to receive therein the at least one projecting part and a guiding plate attached to the shaft of the outboard motor. The opening may comprise a width which is sized to receive therein a combined thickness of the at least one projecting part and an adjacently arranged guiding plate attached to the shaft of the outboard motor. The at least one projecting part may comprise a plurality of projecting parts. Each of the plurality of projecting parts may comprise a small horizontal transverse plate. The protective cage may comprise a plurality of profile bars which run from a top to a bottom of the protective cage.

The at least one projecting part may comprise a plate member. The at least one projecting part may comprise a plurality of spaced apart plate members. The holding device may substantially surround the shaft of the outboard motor. The opening may comprise a circumferential opening. The U-shaped cross-sectional profile may comprise two projecting parts, and one of the two projecting parts comprises recesses which are spaced apart from one another.

The protective cage may comprise a plurality of profile bars which run from a top to a bottom of the protective cage and wherein each recess is structured and arranged to at least partially receive therein one of the plurality of profile bars. The at least one projecting part may comprise a single projecting part which extends around the upper edge of the protective cage. The at least one projecting part may comprise a continuous projecting part which extends around the upper edge of the protective cage.

The U-shaped cross-sectional profile may comprise two projecting parts, and one of the two projecting parts comprises a length which is shorter than a length of the other of the two projecting parts. The length of the shorter projecting part plus a thickness of profile bars of the protective cage may generally correspond to the length of the other of the two projecting parts. The length of the shorter projecting part plus a thickness of an upper portion of the protective cage may generally correspond to the length of the other of the two projecting parts.

The ring element may comprise a flexible one-piece member. The ring element may comprise a two-piece member with movably connected parts.

The invention also provides for a method of protecting a propeller of an outboard motor using the arrangement described above, wherein the method comprises sliding the protecting cage onto and over the shaft of the outboard motor and securing, with the holding device, the protecting cage to a projecting portion of the shaft.

The invention also provides for a method of mounting and removing the arrangement described above to an outboard motor, wherein the method comprises sliding the protecting cage onto and over the shaft of the outboard motor, securing, with the holding device, the protecting cage to a projecting portion of the shaft, and removing the holding device and the protective cage from the shaft.

The invention also provides for a method of mounting and removing the arrangement described above to an outboard motor, wherein the method comprises sliding the protecting cage onto and over the shaft of the outboard motor, securing, with the holding device, the protecting cage to a projecting portion of the shaft by tightening the at least one closure device, loosening the at least one closure device, removing the holding device from the protective cage and the shaft, and removing the protecting cage from the shaft.

The invention also provides for a protective arrangement for an outboard motor, wherein the arrangement comprises a protective cage comprising at least one projecting part which projects radially outwards from an upper edge of the protective cage. A metal holding device is adapted to be removably connected to a shaft of the outboard motor. The holding device comprises a U-shaped cross-sectional profile member with two free ends and at least one closure device adapted to move the free ends towards each other. The U-shaped cross-sectional profile member defines an opening which is adapted to removably receive therein the at least one projecting part when the protective cage is secured to the shaft of the outboard motor with the holding device.

The invention also provides for a method of protecting a propeller of an outboard motor using the arrangement described above, wherein the method comprises sliding the protecting cage onto and over the shaft of the outboard motor and securing, with the holding device, the protecting cage to a projecting portion of the shaft.

The invention also provides for a method of mounting and removing the arrangement described above to an outboard motor, wherein the method comprises sliding the protecting cage onto and over the shaft of the outboard motor, securing, with the holding device, the protecting cage to a projecting portion of the shaft, and removing the holding device and the protective cage from the shaft.

The invention also provides for a method of mounting and removing the arrangement described above to an outboard motor, wherein the method comprises sliding the protecting cage onto and over the shaft of the outboard motor, securing, with the holding device, the protecting cage to a projecting portion of the shaft by tightening the at least one closure device, loosening the at least one closure device, removing the holding device from the protective cage and the shaft, and removing the protecting cage from the shaft.

The invention also provides for a protective arrangement for protecting a propeller of an outboard motor, wherein the arrangement comprises a protective cage comprising at least one projecting part which projects radially outwards from an upper edge of the protective cage. A metal holding device is adapted to be detachably fixed to a shaft of the outboard motor. The holding device comprises a U-shaped cross-sectional profile member with two free ends and at least one closure device adapted to move the free ends towards each other. The U-shaped cross-sectional profile member has two generally parallel projecting portions and defines an opening which is adapted to removably receive therein the at least one projecting part of the protective cage and a projecting portion of the shaft when the protective cage is secured to the shaft of the outboard motor with the holding device.

The U-shaped cross-sectional profile member may comprise a flexible one-piece member. The U-shaped cross-sectional profile member may comprise two parts which are movably connected to each other.

BRIEF DESCRIPTION OF THE DRAWINGS

The invention is explained below on the basis of an exemplary embodiment shown in diagrammatic form in the attached drawing, wherein they show.

DETAILED DESCRIPTION OF THE PRESENT INVENTION

Figure 1:
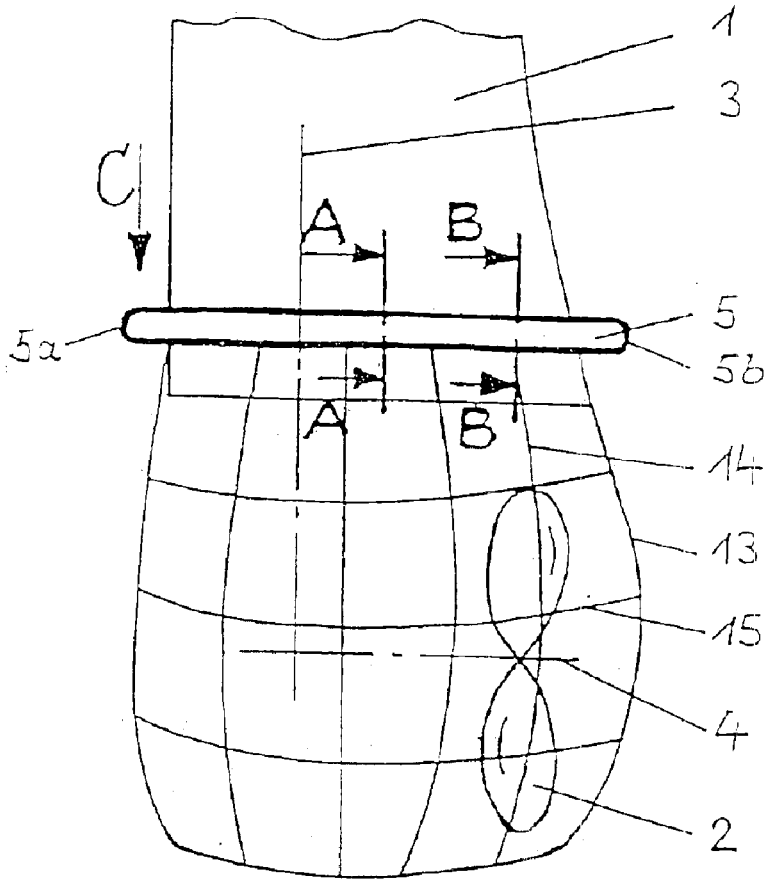
FIG. 1 shows a diagrammatic side view of the lower part of a shaft of a boat outboard motor with a mounted protective cage and its holding device according to the invention.

FIG. 1 shows diagrammatically the lower part of a shaft 1 of a boat outboard motor (not otherwise shown). A propeller 2 is arranged underneath it. Furthermore, the swivel axis 3 of the shaft 1 and the axis of rotation 4 of the propeller 2 are indicated by way of broken lines.

Figure 2:
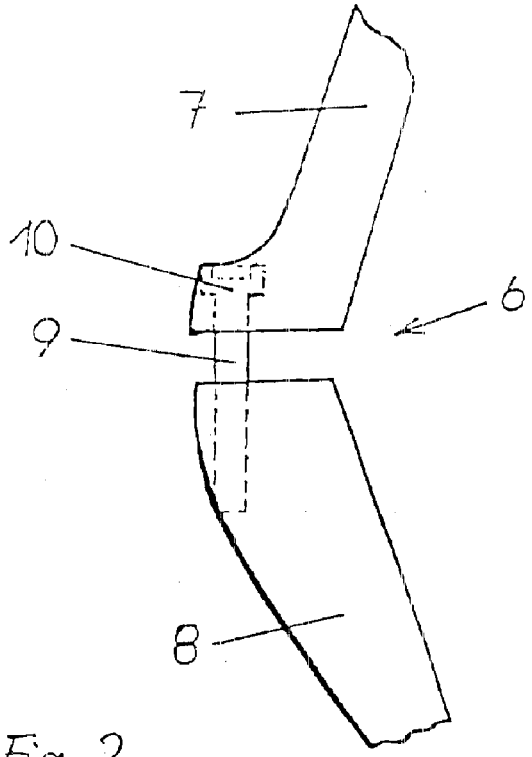
FIG. 2 shows an enlarged diagrammatic plan view of a closure of the holding device according to the invention in the line of sight C in FIG. 1.

A ring element 5 is attached to the shaft 1 of the outboard motor. The ring element includes two parts, i.e., it includes two ring element sections which are of equal size. These parts or sections are firmly connected to one another by way of two screw closures 6. One of the two screw closures 6 is located in the travel direction of the boat and on the front 5*a* of the ring element 5. This is shown in diagrammatic form in FIG. 2 in the plan view according to the line of sight C in FIG. 1. Ends 7, 8 of the two above-mentioned ring element sections are connected to one another by way of a screw bolt 9. The screw bolt 9 has the form of a socket head cap 10. The outer surface of the end 7 of the one ring element section in which the head of the screw bolt 9 is located is embodied such that the screw bolt 9 is countersunk in this end 7, and is thus arranged in a flow-promoting manner.

The other of the two screw closures is arranged on the back 5*b* of the ring element 5 and is embodied in a corresponding manner to the front screw closure 6, i.e., the two screw closures are located at diametrically opposite sides of the ring element 5.

Figure 3:
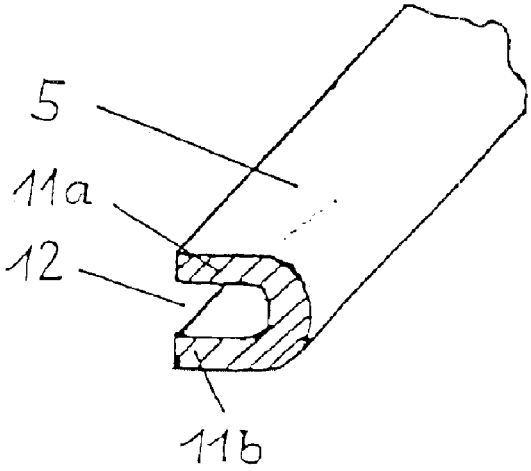
FIG. 3 shows an enlarged diagrammatic perspective view of a cross section of the ring element along the line A—A in FIG. 1.

According to FIG. 3, the cross section of the ring element 5 features a U-shaped profile 11. The opening 12 of this profile extends in the horizontal direction and faces the center of the entire ring element 5.

According to FIG. 1, a protective cage 13 is attached to the shaft 1 of the outboard motor by way of the ring element 5. The cage 13 features, on the one hand, profile bars 14 running from the top to the bottom and intersecting profile bars 15 arranged horizontally, on the other hand.

Figure 4:
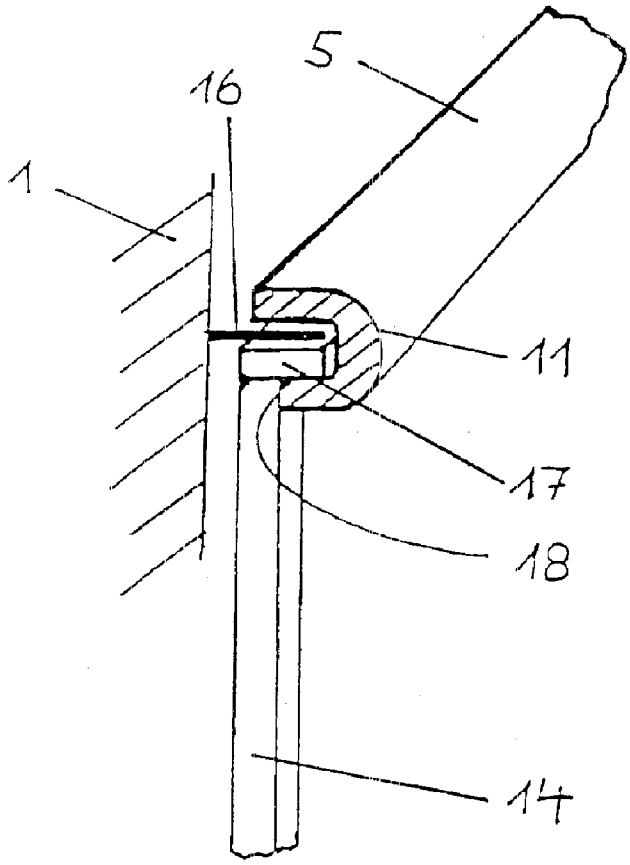
FIG. 4 shows an enlarged perspective diagrammatic view of a cross section similar to FIG. 3, but along the line B—B in FIG. 1. A small transverse plate at the upper edge of the protective cage is inserted in the U-shaped profile of the ring element and a guiding plate of the outboard motor is inserted into this opening.

The type of attachment of the protective cage 13 can be seen from FIG. 4. A guiding plate 16 aligned essentially horizontally outwards is attached to the shaft 1 of the outboard motor. This is a fluidic feature that is customary with this type of motor and that is not especially embodied for the present invention. However, the present invention makes use of the guiding plate 16 in an advantageous manner and uses it as a support for the ring element 5.

The guiding plate 16 extends over the entire circumference of the shaft 1 of the outboard motor. The two ring element sections connected to one another at the screw closures 6 are pushed onto the guiding plate 16. This means that the guiding plate 16 projects into the opening 12 of the U profile 11 of the ring element 5 and thus supports this ring element 5. This is shown in FIG. 4.

To attach the protective cage 13, small horizontal transverse plates 17 are respectively attached to the upper ends of its profile bars 14 that run from the top to the bottom. These transverse plates project towards the outer side of the protective cage 13 and form corresponding projecting parts. These plates are arranged underneath the guiding plate 16 and, like it, project into the opening 12 of the U profile 11. The upper leg 11*a* of the U-shaped profile 11 thus rests on the guiding plate 16 and the small horizontal transverse plates 17 are supported on the lower leg 11*b* of the U-shaped profile. In this way, the protective cage 13 is anchored in the U-shaped profile 11 via the small horizontal transverse plates 17.

To match the profile bars 14 running from the top to the bottom to the ring element 5, in its circumferential direction in the lower leg 11*b* of the U-shaped profile 11, the lower leg 11*b* features recesses 18 spaced apart from one another in which the referenced profile bars 14 of the protective cage 13 are held.

In order to use the holding device according to the invention, the protective cage 13 is raised up from below and over the lower end of the outboard motor until the small transverse plates 17, that are located on the profile bars 14 running from the top to the bottom, rest against the underside of the guiding plate 16.

Subsequently, the two sections of the ring element 5, the screw closures 6 of which are opened, are pushed on from both sides with the opening 12 of the U-shaped profile 11 over the guiding plate 16 and the small transverse plates 17. In this position, the screw closures 6 are closed, and, by tightening the screw bolts 9, they are fixed together with the small transverse plates 17 to the guiding plate 16 of the outboard motor.

To remove the protective cage 13, these assembly steps are carried out in reverse order.

What is claimed:

1. An arrangement for protecting an outboard motor, the arrangement comprising:

a holding device which is made of steel and which is adapted to be detachably fixed to a shaft of the outboard motor;

the holding device comprising a ring element having U-shaped cross-sectional profile and at least one closure device; and a protective cage comprising at least one projecting part which projects radially outwards from an upper edge of the protective cage, wherein the U-shaped cross-sectional profile defines an opening which is adapted to removably receive therein the at least one projecting part when the protective cage is fixed to the shaft of the outboard motor with the holding device.

2. The arrangement of claim 1, wherein the holding device is removable from the protective cage and the opening extends in a generally horizontal direction.

3. The arrangement of claim 1, wherein the opening comprises a width which is sized to receive therein the at least one projecting part and a guiding plate attached to the shaft of the outboard motor.

4. The arrangement of claim 1, wherein the opening comprises a width which is sized to receive therein a combined thickness of the at least one projecting part and an adjacently arranged guiding plate attached to the shaft of the outboard motor.

5. The arrangement of claim 1, wherein the at least one projecting part comprises a plurality of projecting parts.

6. The arrangement of claim 5, wherein each of the plurality of projecting parts comprises a small horizontal transverse plate.

7. The arrangement of claim 6, wherein the protective cage comprises a plurality of profile bars which run from a top to a bottom of the protective cage.

8. The arrangement of claim 1, wherein the at least one projecting part comprises a plate member.

9. The arrangement of claim 1, wherein the at least one projecting part comprises a plurality of spaced apart plate members.

10. The arrangement of claim 1, wherein the holding device substantially surrounds the shaft of the outboard motor.

11. The arrangement of claim 1, wherein the opening comprises a circumferential opening.

12. The arrangement of claim 1, wherein the U-shaped cross-sectional profile comprises two projecting parts, and one of the two projecting parts comprises recesses which are spaced apart from one another.

13. The arrangement of claim 12, wherein the protective cage comprises a plurality of profile bars which run from a top to a bottom of the protective cage and wherein each recess is structured and arranged to at least partially receive therein one of the plurality of profile bars.

14. The arrangement of claim 1, wherein the at least one projecting part comprises a single projecting part which extends around the upper edge of the protective cage.

15. The arrangement of claim 1, wherein the at least one projecting part comprises a continuous projecting part which extends around the upper edge of the protective cage.

16. The arrangement of claim 1, wherein the U-shaped cross-sectional profile comprises two projecting parts, and one of the two projecting parts comprises a length which is shorter than a length of the other of the two projecting parts.

17. The arrangement of claim 16, wherein the length of the shorter projecting part plus a thickness of profile bars of the protective cage generally corresponds to the length of the other of the two projecting parts.

18. The arrangement of claim 16, wherein the length of the shorter projecting part plus a thickness of an upper portion of the protective cage generally corresponds to the length of the other of the two projecting parts.

19. The arrangement of claim 1, wherein the ring element comprises a flexible one-piece member.

20. The arrangement of claim 1, wherein the ring element comprises a two-piece member with movably connected parts.

21. A method of protecting a propeller of an outboard motor using the arrangement of claim 1, the method comprising:

sliding the protecting cage onto and over the shaft of the outboard motor;

securing, with the holding device, the protecting cage to a projecting portion of the shaft.

22. A method of mounting and removing the arrangement of claim 1 to an outboard motor, the method comprising:

sliding the protecting cage onto and over the shaft of the outboard motor;

securing, with the holding device, the protecting cage to a projecting portion of the shaft; and removing the holding device and the protective cage from the shaft.

23. A method of mounting and removing the arrangement of claim 1 to an outboard motor, the method comprising:

sliding the protecting cage onto and over the shaft of the outboard motor;

securing, with the holding device, the protecting cage to a projecting portion of the shaft by tightening the at least one closure device;

loosening the at least one closure device;

removing the holding device from the protective cage and the shaft; and removing the protecting cage from the shaft.

24. A protective arrangement for an outboard motor, the arrangement comprising:

a protective cage comprising at least one projecting part which projects radially outwards from an upper edge of the protective cage, a metal holding device adapted to be removably connected to a shaft of the outboard motor;

the holding device comprising a U-shaped cross-sectional profile member with two free ends and at least one closure device adapted to move the free ends towards each other, wherein the U-shaped cross-sectional profile member defines an opening which is adapted to removably receive therein the at least one projecting part when the protective cage is secured to the shaft of the outboard motor with the holding device.

25. A method of protecting a propeller of an outboard motor using the arrangement of claim 24, the method comprising:

sliding the protecting cage onto and over the shaft of the outboard motor;

securing, with the holding device, the protecting cage to a projecting portion of the shaft.

26. A method of mounting and removing the arrangement of claim 24 to an outboard motor, the method comprising:

sliding the protecting cage onto and over the shaft of the outboard motor;

securing, with the holding device, the protecting cage to a projecting portion of the shaft; and removing the holding device and the protective cage from the shaft.

27. A method of mounting and removing the arrangement of claim 24 to an outboard motor, the method comprising:

sliding the protecting cage onto and over the shaft of the outboard motor;

securing, with the holding device, the protecting cage to a projecting portion of the shaft by tightening the at least one closure device;

loosening the at least one closure device;

removing the holding device from the protective cage and the shaft; and removing the protecting cage from the shaft.

28. A protective arrangement for protecting a propeller of an outboard motor, the arrangement comprising:

a protective cage comprising at least one projecting part which projects radially outwards from an upper edge of the protective cage, a metal holding device adapted to be detachably fixed to a shaft of the outboard motor;

the holding device comprising a U-shaped cross-sectional profile member with two free ends and at least one closure device adapted to move the free ends towards each other, wherein the U-shaped cross-sectional profile member has two generally parallel projecting portions and defines an opening which is adapted to removably receive therein the at least one projecting part of the protective cage and a projecting portion of the shaft when the protective cage is secured to the shaft of the outboard motor with the holding device.

29. The arrangement of claim 28, wherein the U-shaped cross-sectional profile member comprises a flexible one-piece member.

30. The arrangement of claim 28, wherein the U-shaped cross-sectional profile member comprises two parts which are movably connected to each other.

* * * * *